US006447057B1

(12) United States Patent
Chen

(10) Patent No.: US 6,447,057 B1
(45) Date of Patent: Sep. 10, 2002

(54) FOLDING LOUNGE CHAIR

(76) Inventor: Alexander Guy Chen, 414 Lesser St., Oaklano, CA (US) 94601

( * ) Notice: Subject to any disclaimer, the term of this patent is extended or adjusted under 35 U.S.C. 154(b) by 0 days.

(21) Appl. No.: 09/882,180

(22) Filed: Jun. 18, 2001

(30) Foreign Application Priority Data

Apr. 18, 2001 (TW) ..... 090206116

(51) Int. Cl.[7] ..... A47C 4/00
(52) U.S. Cl. ..... 297/16.2; 297/45; 297/440.11
(58) Field of Search ..... 297/16.1, 16.2, 297/45, 46, 55, 56, 440.11

(56) References Cited

U.S. PATENT DOCUMENTS 2,473,090 A * 6/1949 Becker ..... 297/45
2,723,712 A * 11/1955 Yellen ..... 297/440.11
2,916,744 A * 12/1959 May et al. ..... 297/45
4,494,796 A * 1/1985 Liebhold ..... 297/440.11 X
5,320,404 A * 6/1994 Le Gal ..... 297/440.11 X
5,499,857 A * 3/1996 Lynch, Jr. ..... 297/16.2
6,332,646 B1 * 12/2001 Tseng ..... 297/16.1

* cited by examiner

*Primary Examiner*—Peter M. Cuomo
*Assistant Examiner*—Stephen Vu
(74) *Attorney, Agent, or Firm*—Mark J. Spolyar

(57) ABSTRACT

A folding lounge chair easily folded from an open seating position to a flat planar configuration, including an outer ring frame and a cover attached to the outer ring frame to form a back rest and seat. The folding lounge chair features an arrangement of V-shaped legs pivotally attached to the outer ring frame and a rod that releasably secures the V-shaped legs to hold the assembly in the open seating position.

9 Claims, 8 Drawing Sheets

FOLDING LOUNGE CHAIR

BACKGROUND OF THE INVENTION

This invention relates to a lounge chair, more particularly relates to a lightweight folding lounge chair, which is capable of being easily folded from its open seating position to a flat planar and has a cover that can easily be removed, washed, and replaced by the customer.

PRIOR ART OF THE INVENTION

Folding lounge chairs are well known in prior art and are used both indoors and outdoors. Key features are comfort to sit for long periods of time, ease of folding and compactness for portability. However conventional folding lounge chairs demonstrate shortcomings, which significantly hinder their more widespread acceptance and use. Particularly well-known example is the folding butterfly chair, which serves a similar function and market as the present invention. However the butterfly chair suffers from being uncomfortable to sit in for long periods of time as it has very little back support and the sling design of the covers causes the user's legs to feel pinched. Also, because the butterfly chair's canvas covers are supported in only four places, the chair's covers have a tendency to tear at stress points. The chairs designed by Kwon in U.S. Design No. D310605, by Hoffman in U.S. Pat. No. 5,362,130 and by Tang in British Pat. No. 6179374B1 are examples of folding lounge chairs which fold very compactly with crisscrossing leg structures under the seat, however since each of these chairs has canvas covers that is supported at points along the edge of the canvas instead of the full perimeter of the canvas like the present invention, the chairs are less comfortable than the present invention. There consequently exists the need for a lightweight, comfortable, compact, easy to fold folding lounge chair that is both stylish and reasonably priced.

SUMMARY OF THE INVENTION

The present invention solves the above stated as well as other needs and resolves the aforesaid shortcomings of conventional folding lounge chairs. The present invention provides a lightweight folding lounge chair, which is easily folded from its open seating position to a flat planar configuration, comprising an outer ring frame of a generally oval shape tilted at an upward angle to support a fabric panel shaped to form a backrest and seat. Said outer ring frame is supported at the tilted upward angle by three or more V shaped legs with each V shaped leg attached pivotally to the ring frame in two places (at the top of each of the arms of the V shaped legs) so as to allow each V shaped leg to fold into the same plane as the outer ring frame. Two of said V shaped legs each has one arm crossing another arm of the other V shaped leg and a third V shaped leg having a single rod extending from the apex of the V and detachably intersecting with the crossing of said two V shaped legs, said single rod being used to lock the structure of the chair into the seating position or when detached, allowing the structure to collapse into a flat planar configuration.

In accordance with the foregoing it is an object to the present invention to provide a lounge chair, which can be easily folded and unfolded as to be compact for storage and easily transported for outdoor use.

It is another object of the present invention to provide a lounge chair, which is comfortable to sit in for long periods of time and provides good back support as well as seat support.

Another object of the present invention is to provide a folding lounge chair that is constructed of a minimum of parts so that it is both easy to manufacture and reasonably priced to the customer.

Another object of the present invention is to provide a folding lounge chair with a cover that can easily be removed, washed, and replaced by the customer.

BRIEF DESCRIPTION OF THE DRAWINGS

FIG. 5 shows in perspective the folding lounge chair according to the invention in a sequence of four steps during unfolding.

FIG. 9 shows a section detail view of how the wire ring holds the fabric on.

DETAILED DESCRIPTION OF THE PRESENT INVENTION

Figure 1:
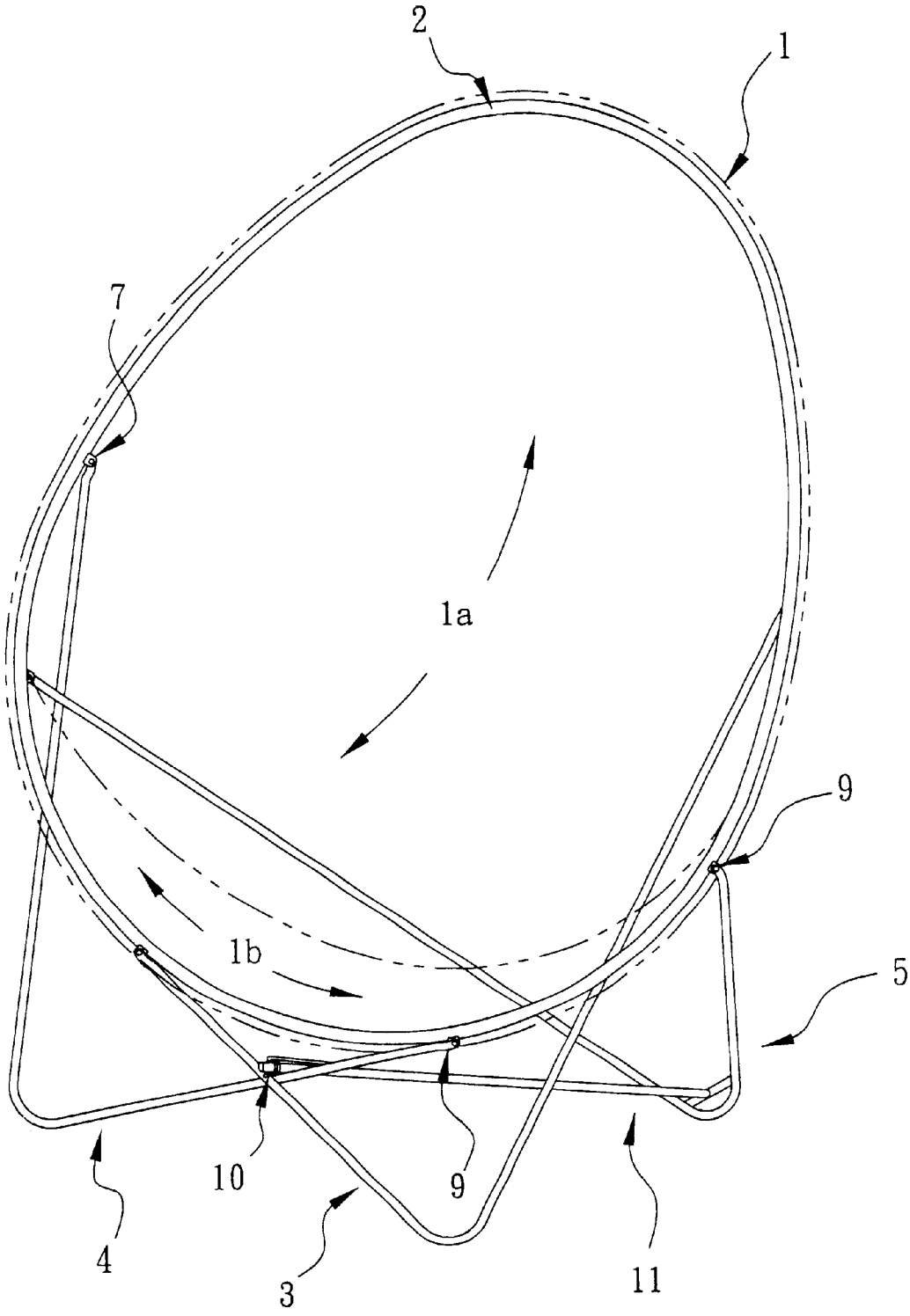
FIG. 1 shows in perspective the folding lounge chair according to the invention in ¾ front-side view.

Referring to the drawings, more particularly by reference number, FIG. 1 is a front perspective view of the lounge chair showing the fabric cover 1 attached to the ring frame 2 and V shaped legs 3,4,5. Because this fabric cover 1 completely conceals the ring frame 2, the fabric cover 1 is shown in dotted line for clarity. As shown in FIG. 1, fabric cover 1 is comprised of two panels, a seat panel 1*b* and a back panel 1*a* sewn together to form a shape that when attached to the ring frame 2 forms a concave shape to support the body.

Figure 2:
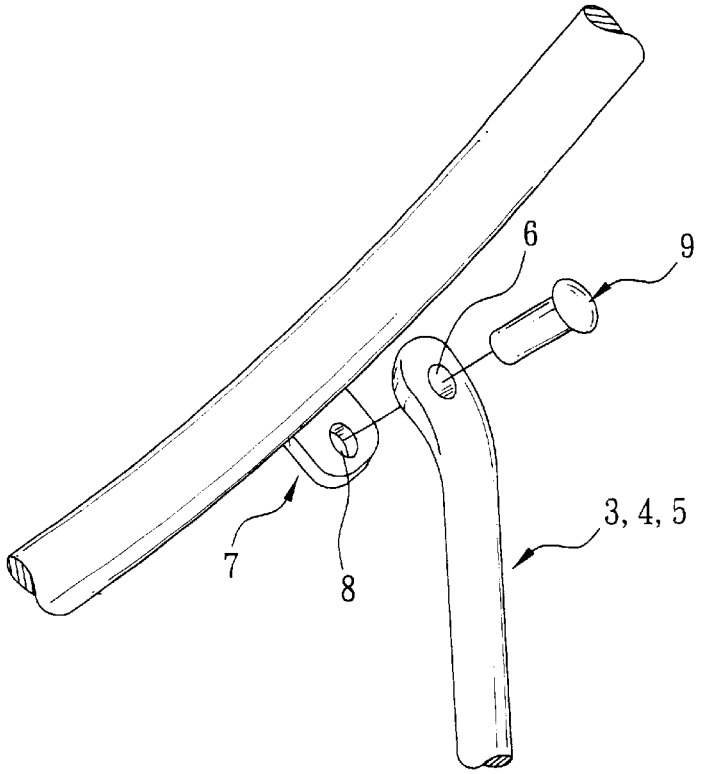
FIG. 2 shows in exploded perspective view a typical joint between the V shaped legs and the ring frame.

Again referring to FIG. 1, three V shaped legs 3,4,5 are pivotally attached to the ring frame 2, each in the form of a bent wire in the shape of a V. Referring to FIGS. 1 and 2, two of the V shaped legs 3,4 are attached to the front of the ring frame 2 with the upper ends of each of the arms of the V shaped legs drilled with a hole 6 to attach to a plate 7 with another hole 8 welded to the ring 2. A rivet 9 connects these two parts, allowing the V shaped legs 3,4,5 to swing freely from the ring frame 2 at these two connections. Two V shaped legs, at right front 3 and left front 4, each has an arm, which cross each other in the front of the chair. Where these two legs 3,4 cross, each arm has a circular ring 10 attached to the arm. When these two legs 3,4 are in the open seating position, the two rings 10 align so that a rod 11 can be passed through both rings 10 to lock the legs 3,4 in the open seating position.

Figure 3:
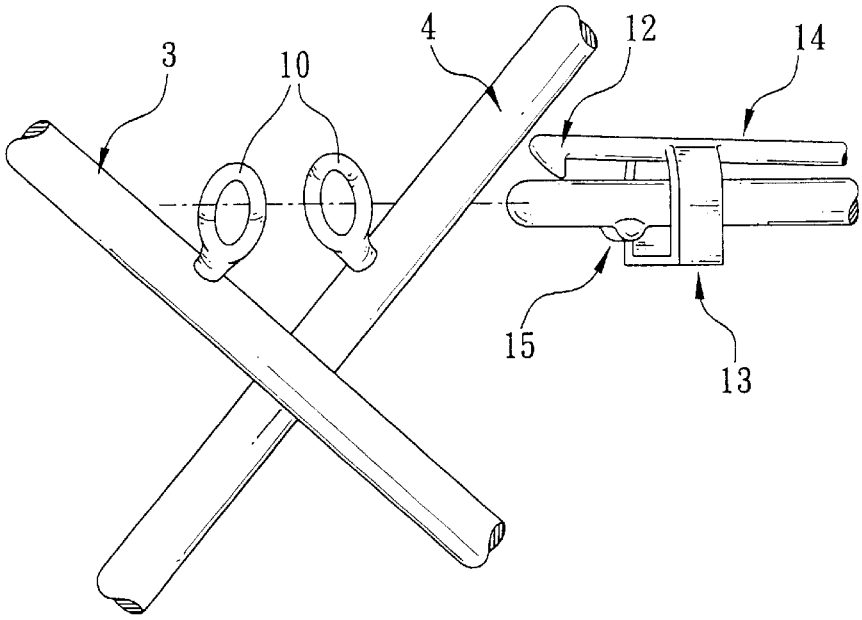
FIG. 3 shows in perspective detail the locking mechanism with the single rod intersecting the two rings attached to the front V shaped legs.
Figure 4A:
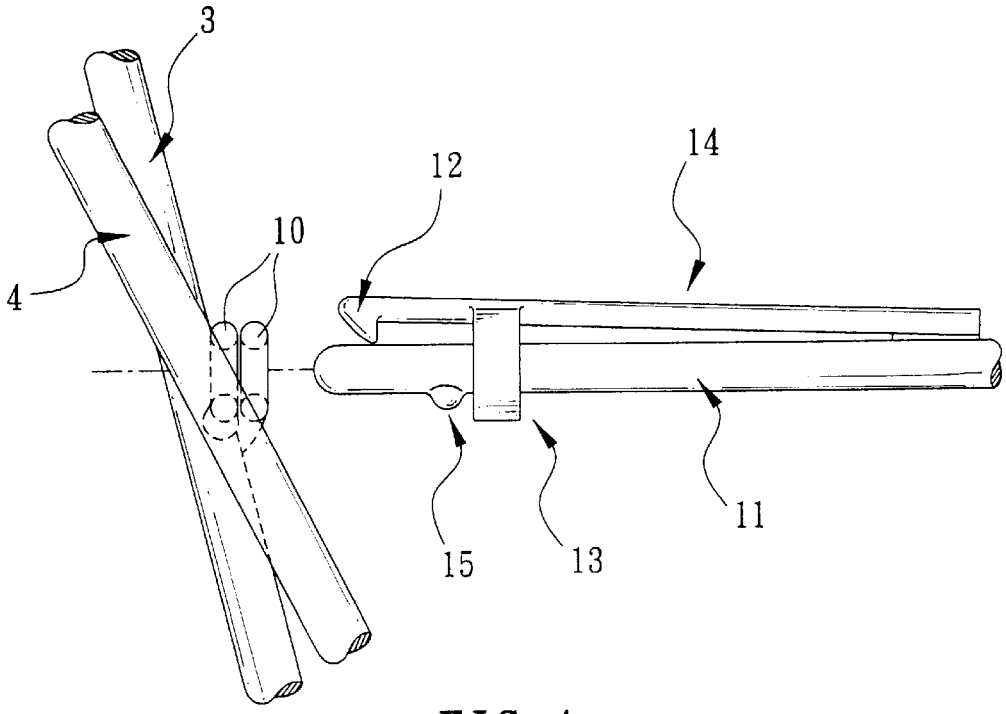
FIGS. 4*a* and 4*b* show in side view the joint shown in FIG. 3 with the single rod unattached and attached to the two rings.
Figure 4B:
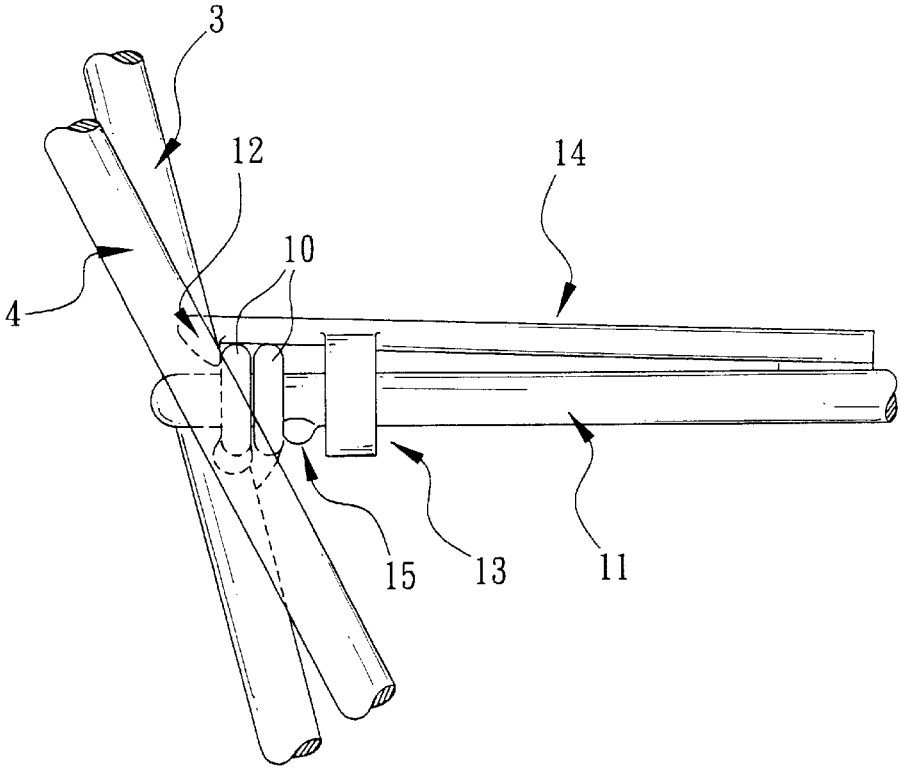

Again referring to FIG. 1, a third V shaped leg 5 is attached to the right and left sides of the ring frame 2 and angles back towards the rear of the chair. The upper ends of the arms of this V shaped leg 5 are attached to the ring frame 2 as the two afore-described V shaped legs 3,4 by using rivets 9 to connect these two parts through holes 6,8. Pivotally attached to and extending out from the vertex of this V shaped leg 5 is a single rod 11 with a latch mechanism at one end. The latch mechanism is shown in detail in FIGS. 3 and 4. The latch mechanism is comprised of a spring-loaded hook 12 with a release button 13. The spring tension is provided by the bending of a wire 14 welded parallel to the rod 11. When the button 13 is pressed, the hook 12 at the end of the spring wire 14 moves away from the rod 11 releasing the latch mechanism. When pressure is taken off the button 13, the hook 12 returns to its closed position resting against the rod 11. A stop bump 15 is located on the rod 11 to ensure that the rings 10 are securely held. FIG. 4*b* shows how the rings 10 are securely held between the hook 12 and the stop bump 15 when the latch mechanism is engaged.

Figure 5A:
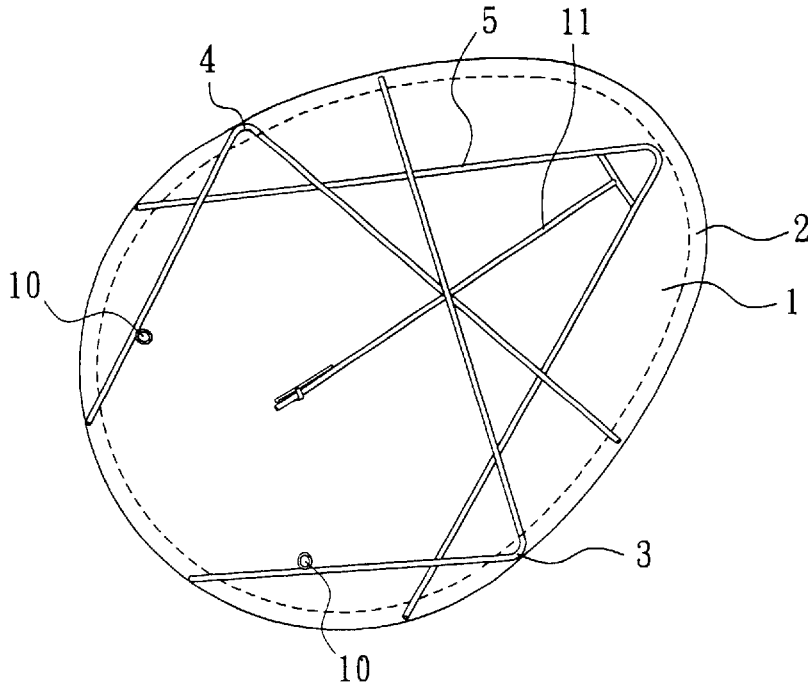
FIG. 5*a* shows the chair closed.

When the folding lounge chair of the present invention isn't in use, these V shaped legs 3,4,5 are easily folded along their pivotal axes allowing the structure to collapse into a flat planar configuration. At the time, the folding lounge chair of the present invention is being used, the chair is opened in accordance with the following steps, as shown in the sequential drawings in FIG. 5:

(1) First, with the ring frame 2 upside down and the fabric cover 1 against the ground, as shown in FIG. 5*a;*

Figure 5B:
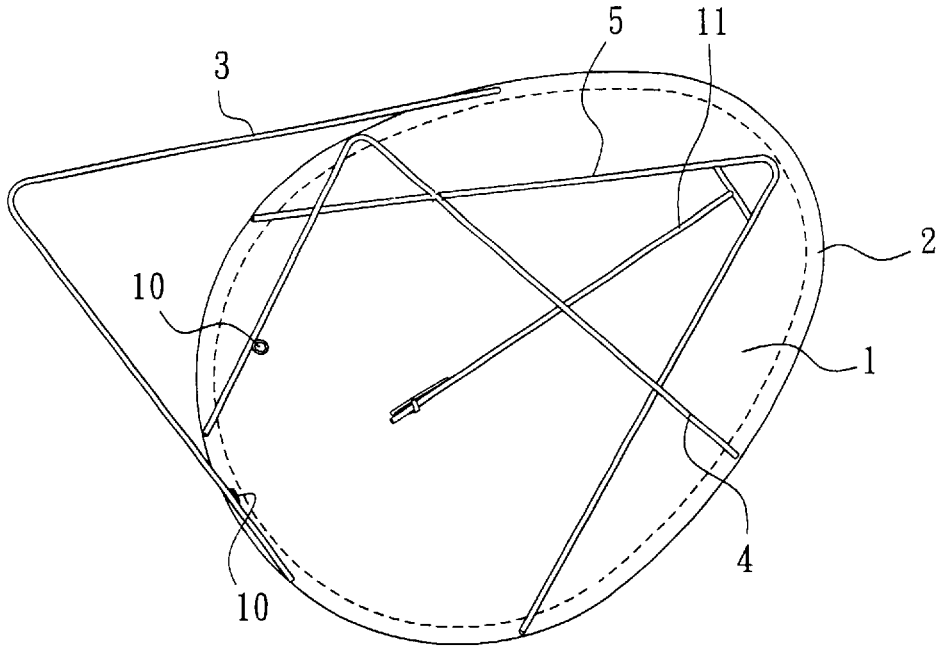
FIG. 5*b* shows the chair during the first step of unfolding.

(2) Then the right front leg 3 is opened all the way, as shown in FIG. 5*b;*

Figure 5C:
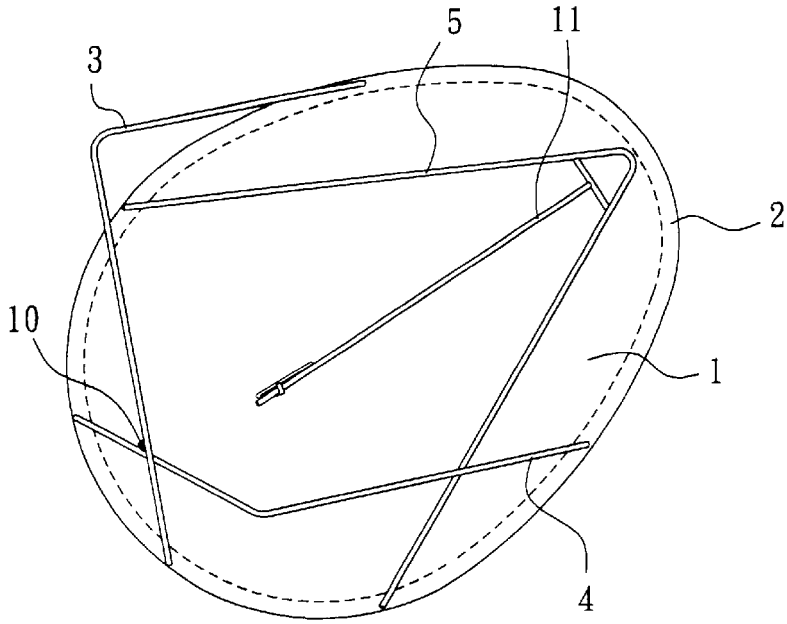
FIG. 5*c* shows the chair during the second step.
Figure 5D:
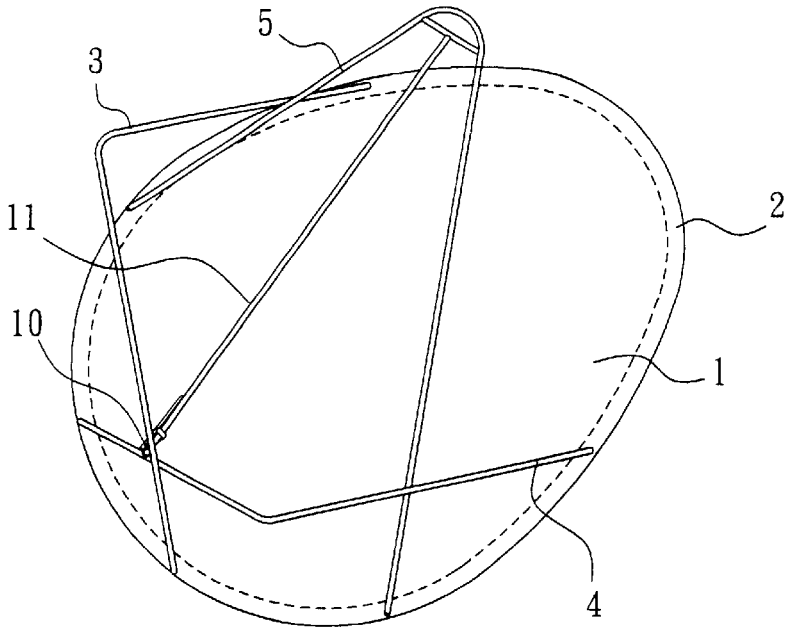
FIG. 5*d* shows the chair during completely ready for use.

(3) Then the left front leg 4 is opened all the way, and the rings 10 on each front leg are matched together and aligned, as shown in FIG. 5*c;*

Figure 6:
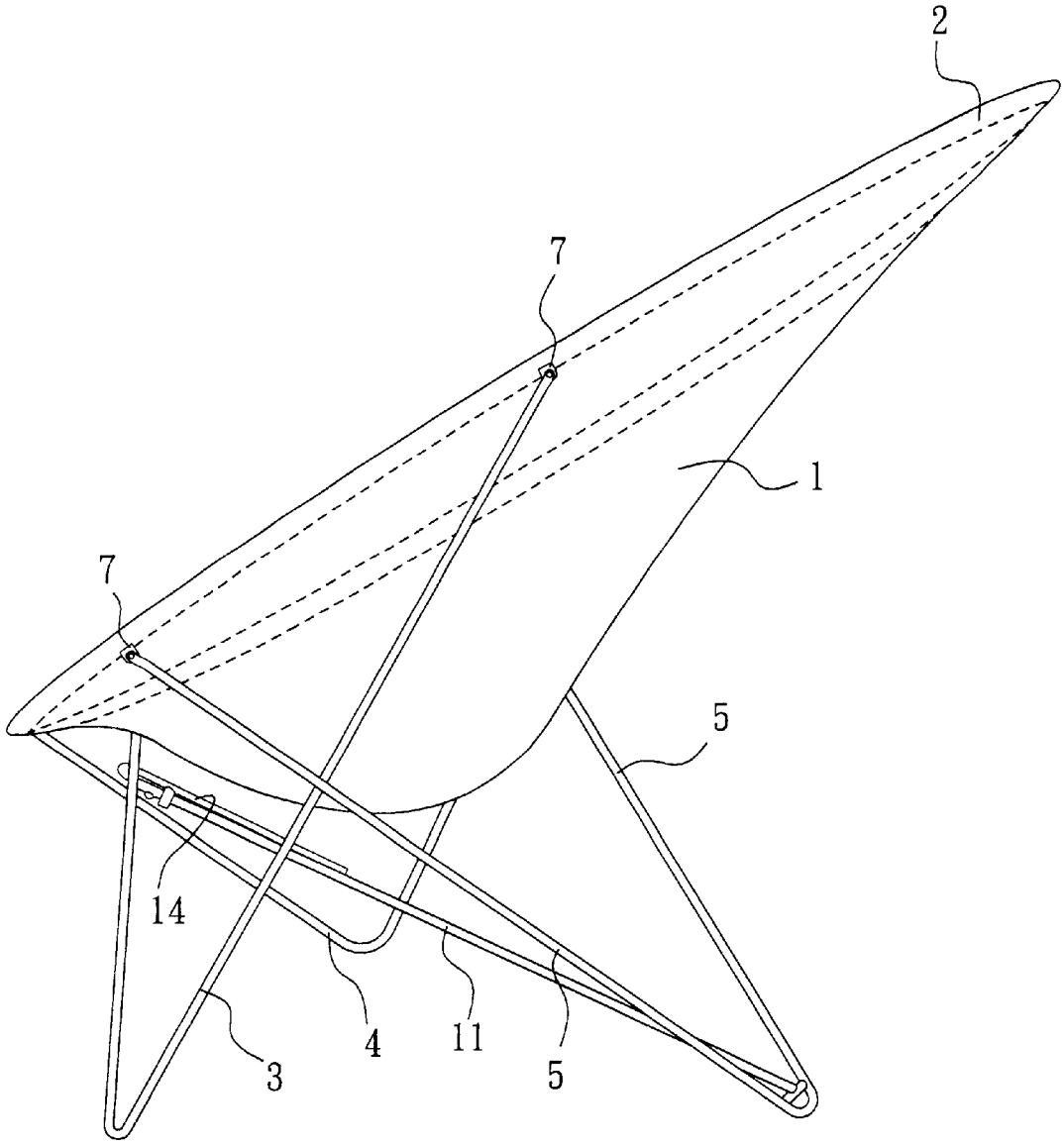
FIG. 6 shows in perspective the folding lounge chair according to the invention in side view.

(4) Finally, the rod 11 with the latch mechanism attached to the rear leg 5 is inserted through the aforementioned aligned rings 10 and locked into place with the spring-loaded hook 12. The hook 12 automatically engages when the rod 11 is inserted to form a lounge chair as shown in FIG. 6, which is comfortable to sit in for long periods of time and has good back support as well as seat support.

To unfold the chair, it only needs to press on the button 13 to release the springloaded hook 12 and reverse the above steps.

Figure 7:
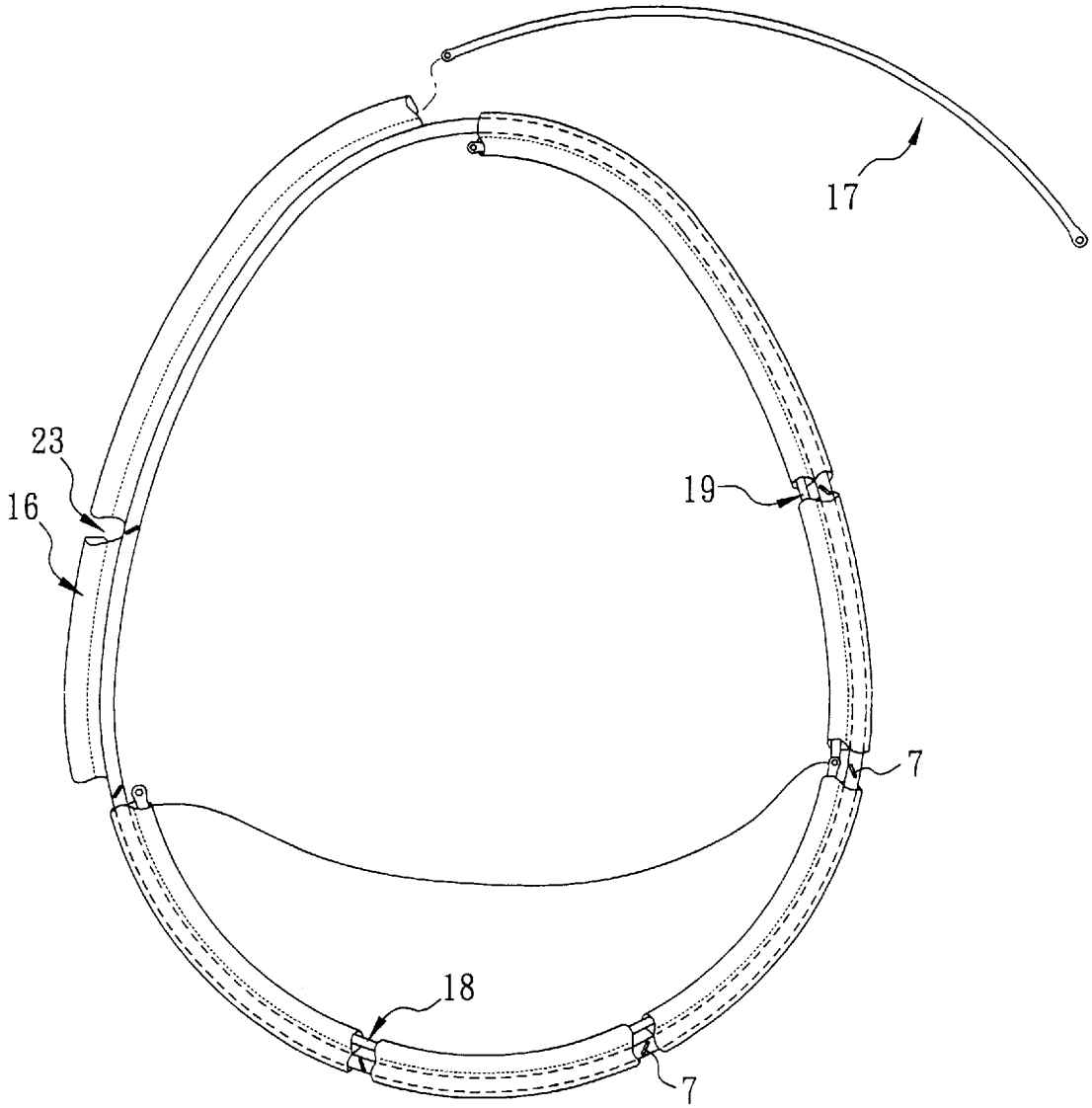
FIG. 7 shows a plan view of the fabric attachment to the frame with two sections of the fabric loop not yet attached by the wire ring.
Figure 8:
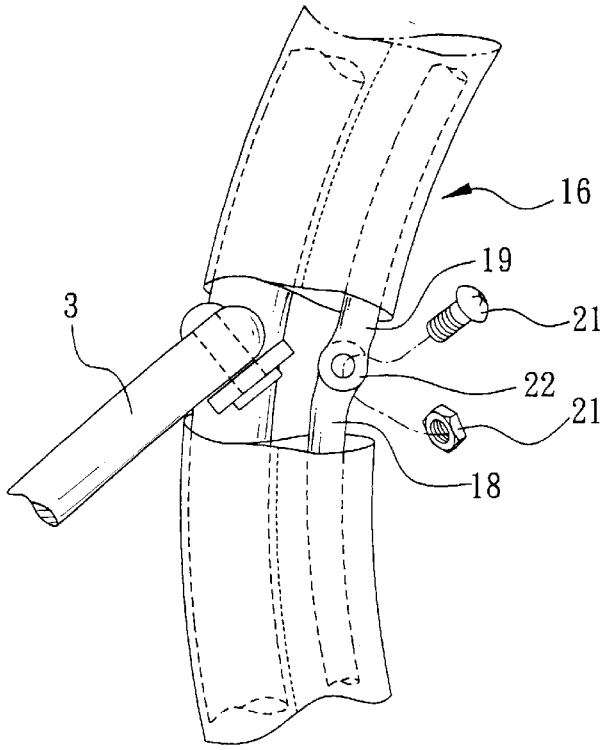
FIG. 8 shows a detail plan view of how the wire ring holds the fabric on and how sections of wire are joined together.
Figure 9:
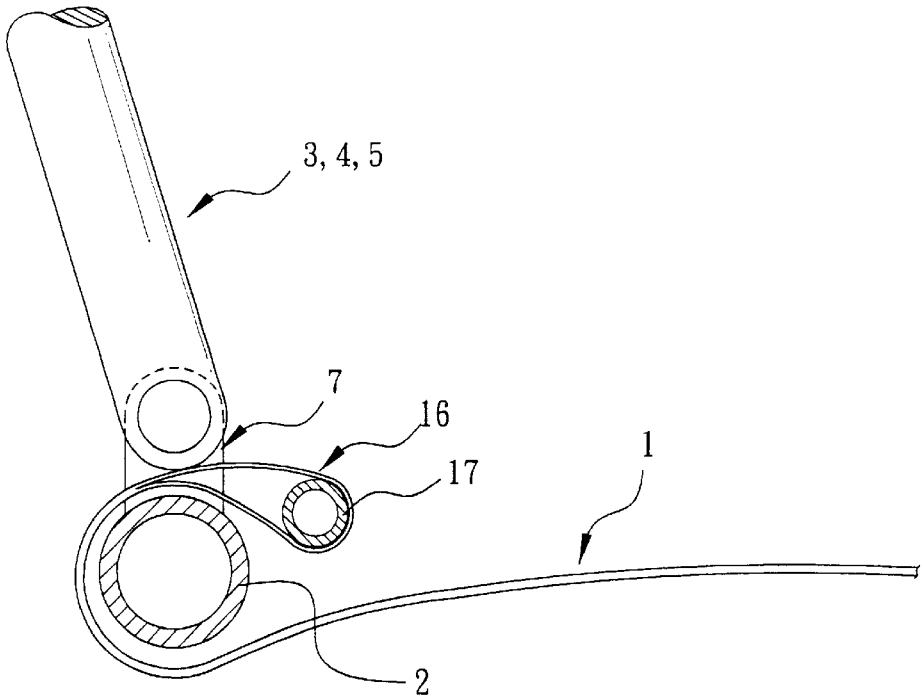

FIG. 7 details how the fabric cover 1 is attached to the ring frame 2. The fabric cover 1 is attached to the ring frame 2 in a detachable manner by means of an inner wire 17, which is inserted through loops 16 in the fabric cover 1. This inner wire 17 is comprised of three pieces of wire 17,18,19, which connect to each other at their endpoints to form a shape echoing the shape of the ring frame 2. For the sake of clarity, the inner wire 17 is shown in a thin dotted line when under the fabric cover 1, and the ring frame 2 is shown in the thick dotted lines when under the cover fabric. FIG. 8 shows how screws and nuts 21 are inserted into holes 22 at the end of each wire segment 17,18,19 to connect the three segments of wire into one continuous inner wire 17. The fabric cover 1 has loops 16 sewn along segments in the perimeter of the shape. Segments are divided by notches 23 in the edge of the fabric cover 1 which correspond to locations of the plates 7 for joining the V shaped legs 3,4,5 to the ring frame 2. This configuration allows the fabric cover 1 to be looped around the ring frame 2 without the need to remove the V shaped legs 3,4,5. When the wire 17 is inserted into the loops 16 and passed on the inside of the leg connection plates 7 at the notches 23, and when the ends of the wires 17,18,19 are attached together forming one continuous wire, the fabric cover 1 is securely fixed to the ring frame 2 and the chair is ready for use. This configuration allows the fabric cover 1 to be easily removed and replaced by the consumer for washing of changing.

Thus, applicant had shown and described a novel chair, which fulfills all of the objects and advantages described. Additional changes, alterations, modifications and alternate uses and applications of the subject folding lounge chair will become apparent to those skilled in the art after considering the present specification and accompanying drawings. All changes, modifications, variations and other uses and applications which do part from the spirit and scope of the invention are deemed to be covered by the invention which is limited only by the following claims.

What is claimed is:

1. A folding chair, comprising:

an outer ring frame;

a cover attached to said outer ring frame and shaped to form a backrest and seat;

a first V-shaped leg comprising a first arm and a second arm extending from the apex of the first V-shaped leg; wherein the outer ends of the first and second arms of the first V-shaped leg are each pivotally attached to the outer ring frame;

a second V-shaped leg comprising a first arm and a second arm extending from the apex of the second V-shaped leg; wherein the outer ends of the first and second arms of the second V-shaped leg are each pivotally attached to the outer ring frame opposite the outer ends of the first and second arms, respectively, of the first V-shaped leg;

a third V-shaped leg, extending rearwardly from the outer ring frame, comprising a first arm and a second arm extending from the apex of the third V-shaped leg; wherein the outer ends of the first and second arms of the third V-shaped leg are pivotally attached to opposing lateral sides of the outer ring frame;

a rod pivotally mounted at a first end substantially at the apex of the third V-shaped leg, wherein a second end of the rod releasably attaches to the respective first arms of the first and second V-shaped legs to lock the outer ring frame, and the first, second and third V-shaped legs in an open seating position

2. The folding chair of claim 1 further comprising a latch mechanism attached to the second end of the rod; and wherein the first arms of the first and second V-shaped legs each include ring members;

wherein, when the first and second V-shaped legs are unfolded into an assembled configuration, the first arms of the first and second V-shaped legs cross each other and align the ring members; and wherein the latch mechanism releasably attaches the second end of the rod to the aligned ring members.

3. The folding chair of claim 2 wherein the latch mechanism comprises;

a spring wire attached to said rod and extending parallel thereto toward the second end of said rod, said spring wire including a hook at the outer end thereof, wherein the second end of said rod extends through said aligned ring members of said first and second V-shaped legs; and said hook releasably engages the ring members to lock the folding lounge chair in an open seating position.

4. The folding chair of claim 3, wherein said latch mechanism further comprises a stop bump located on said rod proximal to said hook to securely hold said ring members between said hook and said stop bump when said latch mechanism engages said rings.

5. The folding chair of claim 1 wherein said cover comprises a seat panel and a back panel sewn together to form a concave shape capable of being attached to said outer ring frame.

6. The folding chair of claim 1, wherein the outer ring frame includes plates attached thereto corresponding to each outer end of the first, second and third V-shapes legs, wherein each of said plates has a hole extending therethrough;

wherein the outer ends of said first, second and third V-shaped legs each have a hole extending therethrough; and wherein the outer ends of said first, second and third V-shaped legs are pivotally attached to said plates by rivets extending through said holes in said outer ends and said corresponding holes in said plates.

7. The folding chair of claim 6, wherein said cover further comprises loops sewn along segments of the perimeter of said cover, said segments are divided by notches corresponding to the locations of said plates attached to said outer ring frame; and wherein said folding chair further comprises an inner wire member, substantially matching the perimeter of said outer ring frame, extending through the loops of said cover; wherein said inner wire member is releasably attached to said outer ring frame to secure said cover to said outer ring frame.

8. The folding chair of claim 7 wherein the inner wire member is located to the inside of said plates relative to said outer ring frame.

9. The folding chair of claim 1, wherein said cover is detachably attached to said outer ring frame.

* * * * *